United States Patent [19]

Winter

[11] 3,930,760

[45] Jan. 6, 1976

[54] HYDRAULIC PUMP INCORPORATING MEANS FOR LIMITING VOLUME OF FLOW

[75] Inventor: Klaus Winter, Schwalbach, Germany

[73] Assignee: ITT Industries, Inc., New York, N.Y.

[22] Filed: Feb. 19, 1974

[21] Appl. No.: 443,490

[30] Foreign Application Priority Data

Apr. 11, 1973 Germany ..... 2318080

[52] U.S. Cl. ..... 417/310

[51] Int. Cl.[2] ..... F04B 49/00

[58] Field of Search ..... 417/284, 310

[56] References Cited

UNITED STATES PATENTS

| | | | |
|---|---|---|---|
| 3,465,679 | 9/1969 | Adey et al. | 417/284 X |
| 3,600,108 | 8/1971 | Tomita | 417/284 X |
| 3,813,187 | 5/1974 | Winter | 417/310 X |

FOREIGN PATENTS OR APPLICATIONS

| | | | |
|---|---|---|---|
| 485,547 | 5/1938 | United Kingdom | 417/310 |

*Primary Examiner*—William L. Freeh
*Assistant Examiner*—Leonard E. Smith
*Attorney, Agent, or Firm*—J. B. Raden; D. P. Warner

[57] ABSTRACT

A pump is disclosed which incorporates regulator means to limit the discharge volume of the pump. The regulator means includes an operating piston which responds to pressure differentials caused by excessively rapid flow through a duct. The pressure difference is used to overcome a spring bias and operate a pressure relief valve.

5 Claims, 2 Drawing Figures

HYDRAULIC PUMP INCORPORATING MEANS FOR LIMITING VOLUME OF FLOW

CROSS REFERENCE TO RELATED APPLICATIONS

The present invention is related to the subject matter of U.S. Pat. application No. 353,228, now patent No. 3,813,187, directed to "A Vane Type Hydraulic Pump", which was filed on Apr. 22, 1973 in the name of Klaus Winter.

BACKGROUND OF THE INVENTION

1. Field of the Invention.

This invention relates to a vane-type hydraulic pump for use in hydrostatic systems, the discharge volume thereof being limited by a by-pass regulator which is made responsive to pressure differences which arise when volume exceeds a desired level.

2. Description of the Prior Art.

It is known in the prior art to control pressure-medium pumps by means of a by-pass regulator. In the known embodiments, however, necessary valves have been placed either in the housing member or in the pump housing cover. A disadvantage of this prior construction has been that special ducts and bores had to be provided in the housing resulting in relatively large overall dimensions of such pumps.

SUMMARY OF THE INVENTION

It is an object of the present invention to provide an efficient pressure-medium pump of particularly light weight and small dimensions. It is an additional object with such a pump to provide means to limit the volume of pressure medium discharged. Furthermore, it is an object to arrange pressure-medium connectors or parts to function independently of the position of said means to limit volume of flow.

In accordance with the present invention, the various objects are achieved by positioning the operating piston of the flow-control valve in a concentric pump-shaft bore communicating with the pressure chambers of the pump. Furthermore, the pump-shaft bore may preferably include a pressure-relief valve limiting the pressure which tends to close the overflow lines by moving the operating piston. By this means it is accomplished that the relief valve acts as an anticipatory control for the flow-control valve, to the effect that upon opening of the relief valve the pressure loading the operating piston in closing direction will decrease, thus causing the operating piston to be moved to open the overflow line. Simplification of manufacture is advantageously achieved by accommodating the orifice of the flow-control valve between the delivery-sided port of the pump and the pressure accumulator. In order to increase pump efficiency, the suction chamber of the pump contains an annular collar spaced from the pump shaft and embracing it concentrically, said collar forming together with the side wall of the pump housing an annular opening wherein there are terminating essentially radially extending ducts provided in the pump shaft and forming the overflow line, so that overflow of pressure medium will result in an injection effect.

BRIEF DESCRIPTION OF THE DRAWINGS

This invention allows for a large variety of embodiments. One embodiment will be described with reference to the attached drawing in which.

DESCRIPTION OF A PREFERRED EMBODIMENT

Figure 1:
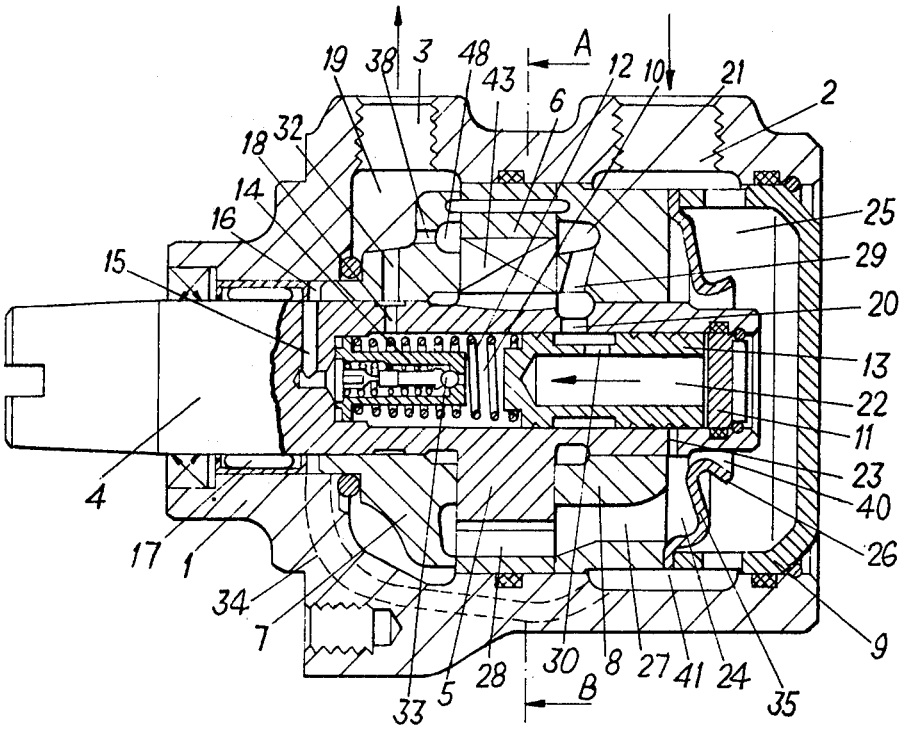
FIG. 1 is a longitudinal view of the hydraulic pump.
Figure 2:
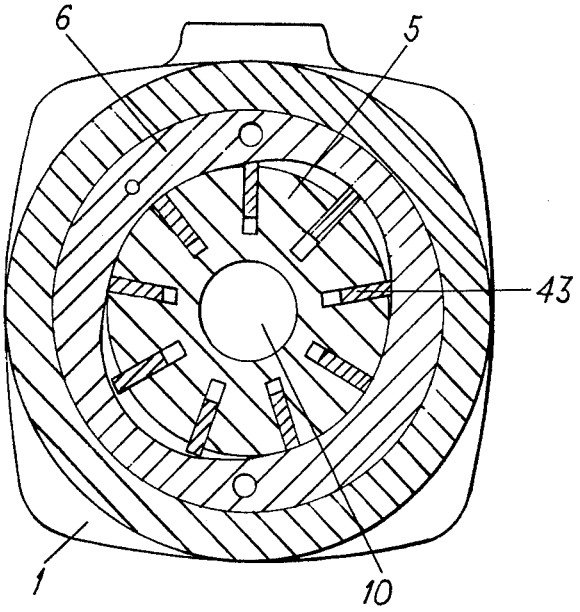
FIG. 2 is a cross-sectional view of the pump on the lines A–B of FIG. 1.

In essence, the pump includes the pump housing 1, comprising the suction connector 2 and the pressure connector 3; the pump shaft 4 supported in the housing 1 and comprising the rotor 5 and the vanes 43 (radially movable lamellae); the stationary cam disc 6; the side plates 7, 8; and the housing cover 9 tightly sealing the pump housing 1.

The pump shaft 4 is provided with a blind bore 10 closed by means of a disc 11 and containing a piston 13 which is movable in longitudinal direction against the force of a pressure spring 12. The blind bore 10 also contains a pressure-relief valve indicated generally by numeral 14. In addition, a plurality of radially extending ducts are provided in the pump shaft 4, connecting the longitudinal bore 10 with the pump working chambers filled with pressure medium and disposed radially outwardly. Said ducts are: Duct 15 connecting the chamber behind the pressure-relief valve 14 with the ring duct 16 for lubricating the pump-shaft bearing 17; the radial bores 18 connecting the chamber between the piston 13 and the relief valve 14, via the duct 32 in the side plate 7, to the delivery-sided annular chamber 19; the radially extending ducts 20 connecting the pocket 21 in the side plate 8 with the blind bore 22 of piston 13; and finally the radially extending ducts 23 connecting the blind bore 10 of the pump shaft 4 with the annular chamber 24 disposed between the side plate 8 and the collar 35.

When the pump shaft 4 is driven, the pressure medium to be supplied will be sucked in via the suction connector or suction port 2, flowing therefrom to chamber 25 between the housing cover 9 and the collar 35. The medium then flows through the space or annular port, 40 between the rim 26 of the collar 35 and the pump shaft 4 into the annular chamber 24 until it reaches the working chambers 28 of the rotor 4 via an axially extending duct 27. Flow is then directed into the pockets 48 and 21 and through duct 38 into the annular chamber 19 from which the pressure medium will be supplied to the pressure connector or pressure port 3.

The cross-sectional area of duct 38 being small, it will serve as a throttle, thus producing a differential pressure which is less at the output than at the input of duct 38 when pressure medium flows through. This differential pressure acts, via the ducts 19, 32, 18, on the spring-loaded side of the operating piston 13, and via the pocket 21, and the ducts 29, 20, 30, on the other side of the operating piston 13 serving as a piston manometer. So long as the force acting on the operating piston 13 and ensuing from the differential pressure occasioned by duct 38 is smaller than the biasing force of the spring 12, the operating piston 13 will be urged against the disc 11, thereby first blocking the ducts 23 which constitute the overflow line.

When the pump discharge volume increases, for example due to increases in its driving speed, the differential pressure across duct 38 will also increase until the force acting on the operating piston 13 overcomes the force of the spring 12 and moves the operating piston 13 towards the spring 12 and opens the ducts 23. Part of the pump discharge volume is now allowed to flow into the suction chamber 24 via the pocket 21, the ducts 29, 20, 30, the bore 22 and the ducts 23, so as to avoid an increase in the amount of fluid discharged at the pressure connector 3.

If an undesirably high pressure builds up at the pressure connector 3, in the annular chamber 19 and, consequently, also at the front end of the operating piston 13 loaded by the spring 12 and communicating with the annular chamber 19 via the ducts 32, 18, the ball 33 of the pressure-relief valve 14 will be lifted from its seat, thus opening the pressure-medium passageway towards the duct 15 and the ring duct 16, respectively. From ring duct 16, pressure medium is allowed to flow back through a duct 34 to the suction-sided pocket 21.

As the pressure-relief valve 14 is opened, the pressure prevailing on the spring-loaded side of the operating piston 13 will decrease simultaneously, thus causing the operating piston 13, under the influence of the higher pressure prevailing on its opposite side, to be moved towards the pressure-relief valve 14 against the force of the spring 12, thereby causing the ducts 23 to be opened and allowing the pressure medium fed to flow into the suction chamber. During this control cycle, the pressure-relief valve 14, in combination with the operating piston 13, acts like a pilot-operated relief valve.

The pressure-medium pump described above includes both a flow-control valve 13, 30 and a pressure-relief valve 14. Both valves are disposed concentrically in the pump shaft.

The injection effect, i.e., the effect produced by the injection of pressure medium into the annular chamber 24 within the area of the annular port 40 has proved to be particularly advantageous, the specially designed collar 35, 26, in combination with the duct 23, serving as an aid to improve pump performance. The guide for the bypass spring 12 is coated with suitable plastics material (e.g., PTFE) in order to minimize the influence of friction in the event of buckling, e.g., due to centrifugal forces occasioned at high rotational speeds.

What is claimed is:

1. In a vane-type hydraulic pump, a rotor formed about a pump shaft within a pump housing, and flow control means for regulating discharge volume of the pump comprising an operating piston and a pressure relief valve disposed in a concentric bore within walls of the pump shaft, inlet and outlet means extending through said housing, duct means and chambers providing paths through a pressure line interconnecting said inlet and outlet means through walls of the piston and the pump shaft, means for sensing volume of flow in said pressure line and for providing the transfer of pressure signals through ducts in said piston to govern the position of said operating piston relative to an overflow line to thereby control volume of flow.

2. The invention as claimed in claim 1, in which the overflow line includes a duct of restricted diameter through the pump shaft wall between the concentric bore and the pressure line, whereby movement of the operating piston to open the overflow line permits pressure medium in the piston to flow into the pressure line to enhance the pump effect.

3. The invention as claimed in claim 1, in which the means for sensing volume of flow includes a duct in said pressure line which provides a differential pressure between two chambers in the pressure line and duct means which couple said two chambers to respective sides of the operating piston within the concentric bore, said operating piston responding to a selected difference in pressure to open said overflow line and reduce pressure in said pressure line.

4. The invention as claimed in claim 1, in which the pump includes a suction chamber bounded by an annular collar spaced from the pump shaft and embracing it concentrically, said collar forming together with a side wall of the pump housing an annular opening wherein there are terminating essentially radially extending ducts provided in the pump shaft and forming the overflow line.

5. The invention as claimed in claim 4, in which injection of a pressure medium is provided by an annular port formed between the side wall of the pump housing and the annular collar, where the annular port enlarges towards a suction duct in the direction of rotation.

* * * * *